US009771951B2

(12) United States Patent
Ho

(10) Patent No.: US 9,771,951 B2
(45) Date of Patent: Sep. 26, 2017

(54) COMPOSITE COOLING FAN

(71) Applicant: COOLER MASTER CO., LTD., New Taipei (TW)

(72) Inventor: Chang-Yen Ho, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 274 days.

(21) Appl. No.: 14/677,304

(22) Filed: Apr. 2, 2015

(65) Prior Publication Data

US 2015/0337860 A1 Nov. 26, 2015

(30) Foreign Application Priority Data

May 22, 2014 (TW) ..... 103208985 U

(51) Int. Cl.

| | |
|---|---|
| ***F04D 29/64*** | (2006.01) |
| ***F04D 19/00*** | (2006.01) |
| ***F04D 29/52*** | (2006.01) |
| ***F04D 17/02*** | (2006.01) |
| ***F04D 17/16*** | (2006.01) |
| ***F04D 25/06*** | (2006.01) |
| ***F04D 27/00*** | (2006.01) |
| ***F04D 29/46*** | (2006.01) |

(52) U.S. Cl.

CPC ..... *F04D 29/646* (2013.01); *F04D 17/025* (2013.01); *F04D 17/16* (2013.01); *F04D 19/002* (2013.01); *F04D 25/0613* (2013.01); *F04D 27/008* (2013.01); *F04D 29/462* (2013.01); *F04D 29/522* (2013.01)

(58) Field of Classification Search

CPC ..... F04D 19/002; F04D 29/522; F04D 29/646
See application file for complete search history.

(56) References Cited

U.S. PATENT DOCUMENTS

| | | | | |
|---|---|---|---|---|
| 2,277,868 | A * | 3/1942 | Meyerhoefer | F04D 25/166 416/175 |
| 5,699,854 | A * | 12/1997 | Hong | F04D 25/08 165/121 |
| 5,879,141 | A * | 3/1999 | Yokozawa | F04D 25/064 310/62 |
| 6,179,561 | B1 * | 1/2001 | Horng | F04D 25/0653 361/679.48 |
| 6,648,602 | B2 * | 11/2003 | Horng | F04D 29/666 416/203 |
| 7,416,481 | B2 * | 8/2008 | Baker | F04D 25/14 361/679.48 |
| 2011/0250047 | A1 * | 10/2011 | June | F04D 29/422 415/1 |

* cited by examiner

*Primary Examiner* — Igor Kershteyn
(74) *Attorney, Agent, or Firm* — Maschoff Brennan

(57) ABSTRACT

A composite cooling fan includes a frame, a fan blade and a lateral valve. The frame has an air hole penetrating the frame and a lateral air outlet locating on one side of the frame and connecting with the air hole. The fan blade is disposed in the air hole and includes an impeller, multiple axial blades surrounding the impeller and multiple centrifugal blades surrounding the axial blades. The lateral valve is disposed on the lateral air outlet and includes a valve stem and a switch baffle linked with the valve stem. The valve stem is used for making the switch baffle at the lateral air outlet open or close.

9 Claims, 4 Drawing Sheets

COMPOSITE COOLING FAN

TECHNICAL FIELD

The disclosure relates to a cooling fan, more particularly to an improved composite cooling fan.

BACKGROUND

Cooling fans are essential to today's computers. A traditional cooling fan mainly includes axial fans and centrifugal fans and is widely used in the computer industry for heat dissipation. The axial fans and the centrifugal fans may also be integrated so that a single cooling fan is capable of cooling multiple heat sources or a targeted heat area. That is, it may not only blow axial airflow but also blow lateral airflow from one side of the cooling fan, thereby dissipating heat from multiple heat sources or from a targeted heat area.

In the traditional cooling fan with integrated axial fans and the centrifugal fans, however, the lateral airflow thereof cannot be opened or closed by control, or its direction is fixed to a single direction so it cannot be adjusted. This is troublesome and needs to be improved.

SUMMARY

The main purpose of the disclosure is to provide an improved composite cooling fan capable of generating airflow from an axial direction and from a lateral direction at the same time. Besides, the lateral airflow from the cooling fan may be controlled to be opened or be closed.

The other purpose of the disclosure is to provide an improved composite cooling fan capable of being at an oblique angle after opening lateral airflow so that it is able to generate airflow from an axial direction as well as from a lateral oblique direction at the same time.

To fulfill the main purpose, the disclosure provides an improved composite cooling fan comprising a frame, a fan blade and a lateral valve. The frame has an air hole penetrating the frame and a lateral air outlet locating on one side of the frame and connecting with the air hole. The fan blade is disposed in the air hole and comprises an impeller, a plurality of axial blades surrounding the impeller and a plurality of centrifugal blades surrounding the axial blades. The lateral valve is disposed on the lateral air outlet and comprises a valve stem and a switch baffle linked with the valve stem. The valve stem is configured for making the switch baffle at the lateral air outlet open or close.

To fulfill the other purpose, the disclosure provides another improved composite cooling fan, in which the switch baffle arcs towards the lateral air outlet so it remains at an oblique angle after being opened.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
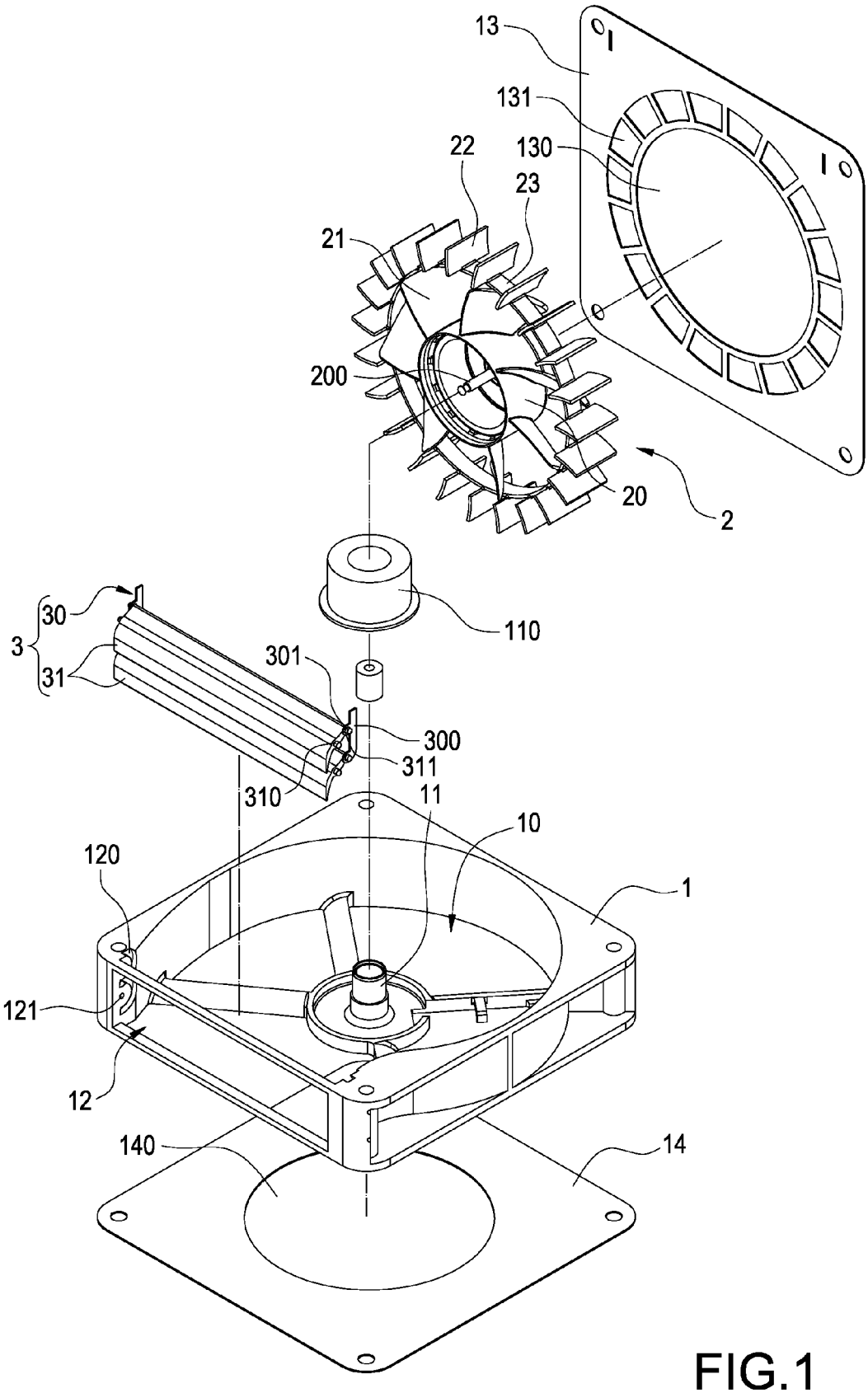
FIG. 1 is an exploded view of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
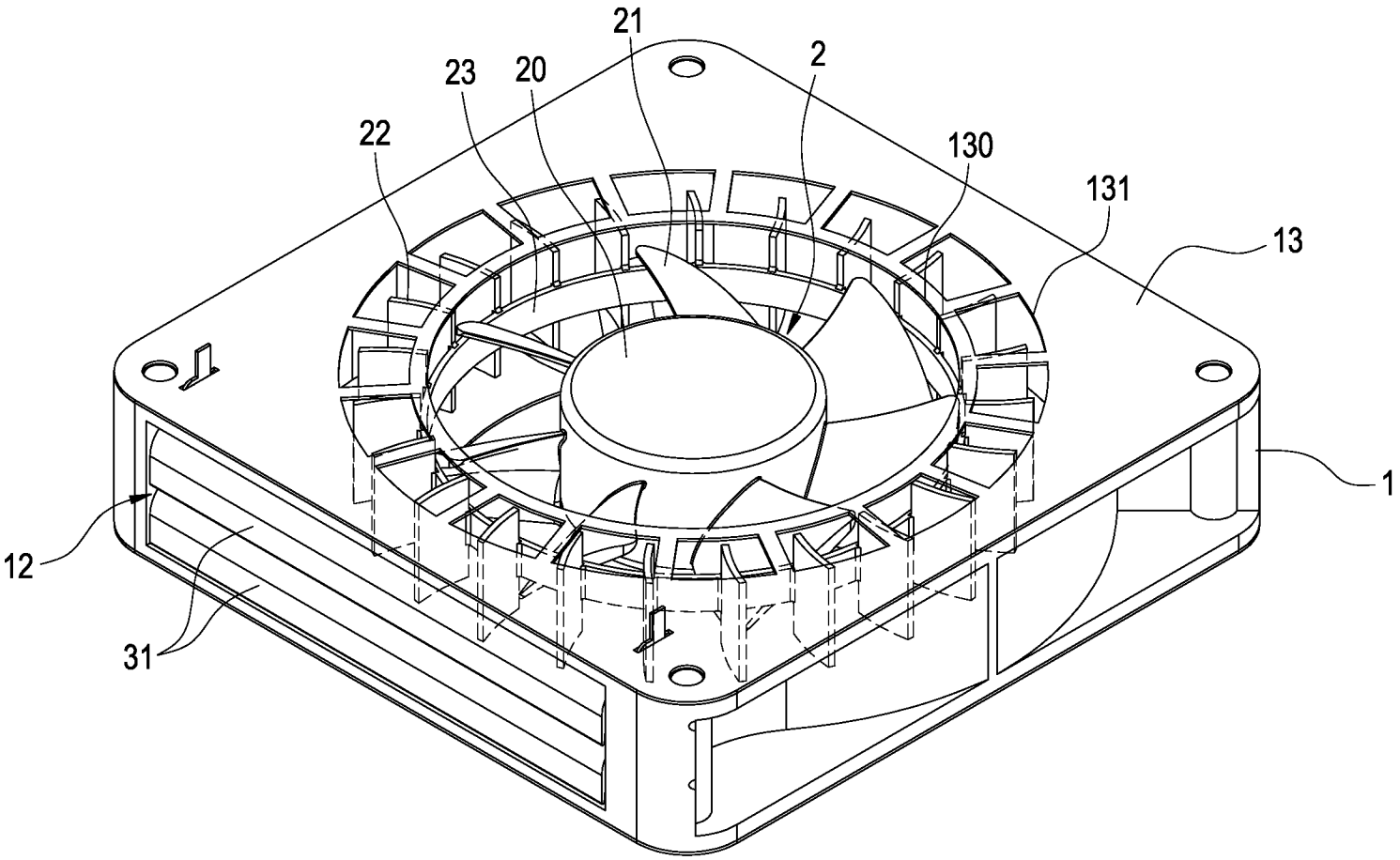
FIG. 2 is a perspective view of the disclosure.
Figure 3:
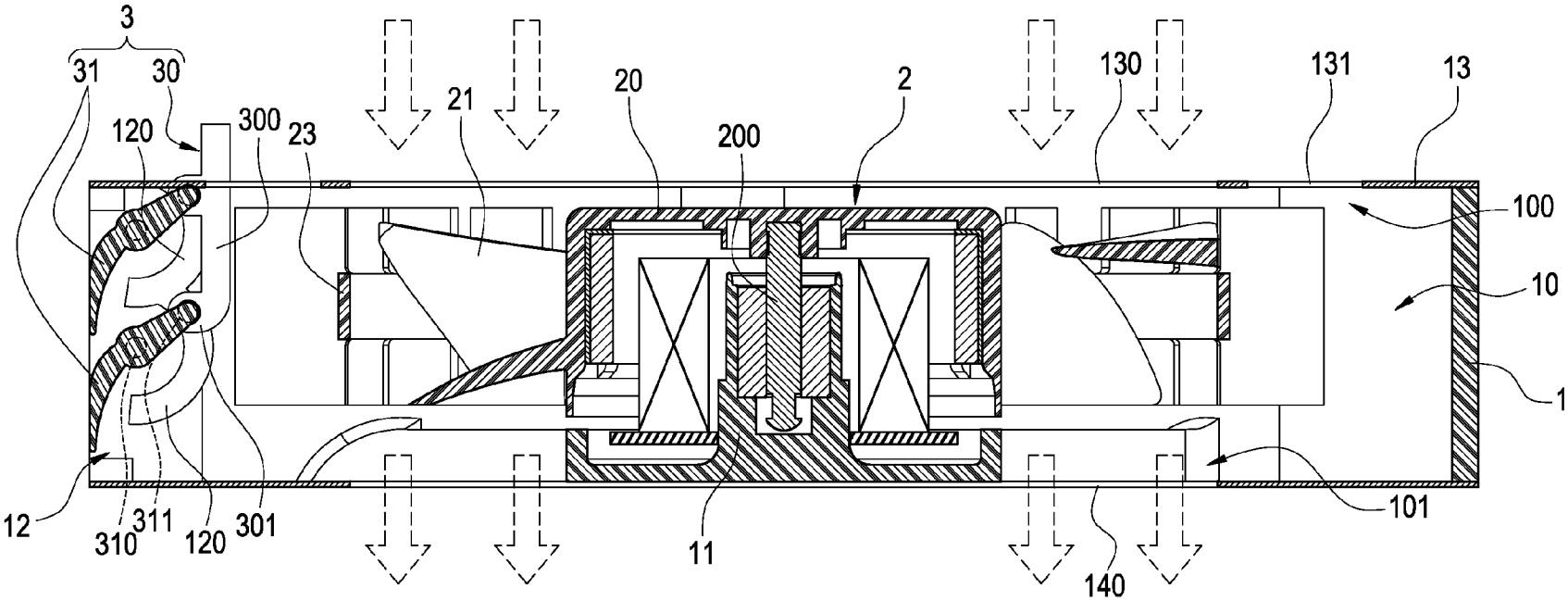
FIG. 3 is a sectional view of the disclosure where a lateral valve is closed.

FIG. 1 to FIG. 3 are an exploded view of the disclosure, a perspective view of the disclosure and a sectional view of the disclosure where a lateral valve is closed, respectively. The disclosure provides an improved composite cooling fan comprising a frame 1, a fan blade 2 and a lateral valve 3.

The frame 1 is used for carrying the fan blade 2 and the lateral valve. The frame 1 has an air hole 10 penetrating the frame 1, thereby forming an axial air inlet 100 and an axial air outlet 101 on the frame 1. A fan base 11 for a stator of the fan to be disposed on is disposed in the air hole 10 of the frame 1. Additionally, a lateral air outlet 12 is formed on one side of the frame 1 and is connected to the air hole 10.

The fan blade 2 is disposed in the air hole 10 of the frame 1 and comprises an impeller 20, a plurality of axial blades 21 surrounding the impeller 20 and a plurality of centrifugal blades 22 surrounding the axial blades 21. The impeller 20 has an axis for being pivoted on the fan base 11 to perform electromagnetic induction with the stator 110, thereby making the fan blade 2 operate. In the embodiments of the disclosure, a connecting ring 23 is disposed on and surrounds the axial blades 21 of the fan blade 2, and the centrifugal blades 22 surround and are disposed on the connecting ring 23. Thereby, the centrifugal blades 22 may be disposed on and surround the axial blades 21.

Figure 4:
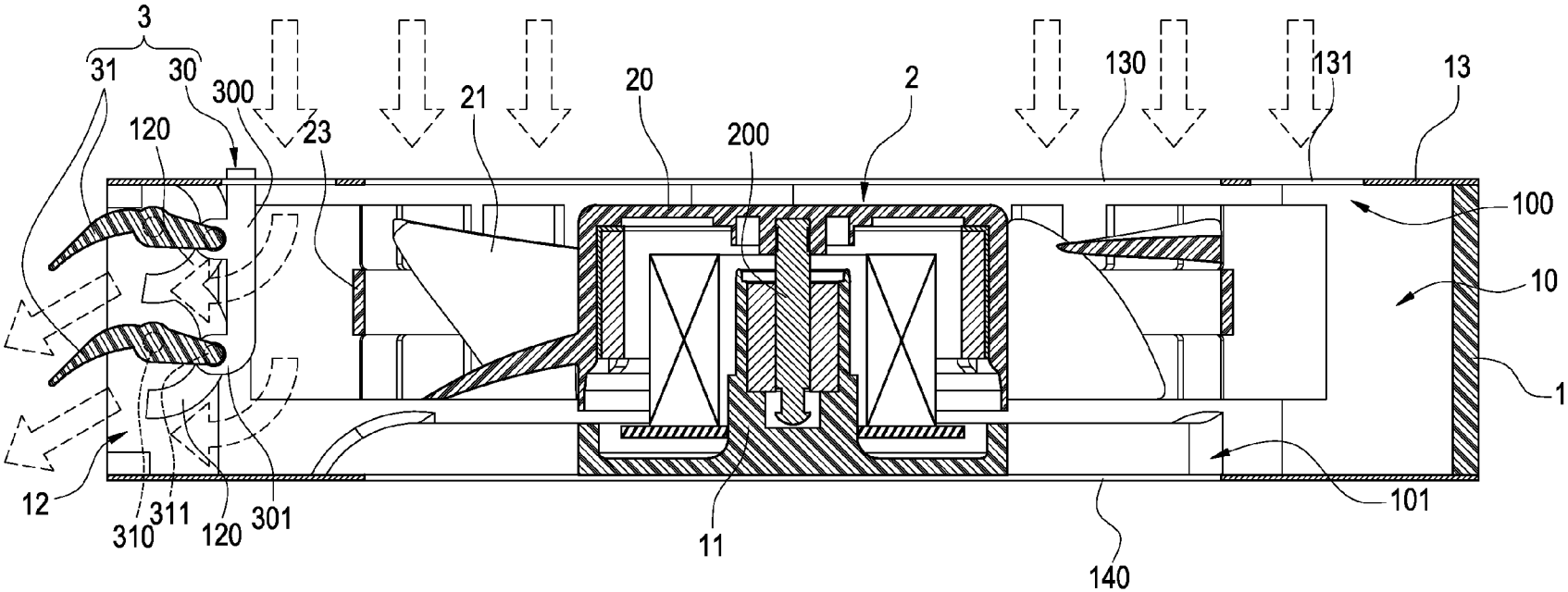
FIG. 4 is a sectional view of the disclosure where the lateral valve is opened.

The lateral valve 3 is disposed on the lateral air outlet 12 of the frame 1 such that it can make the lateral air outlet 12 be opened or be closed. The lateral valve 3 comprises at least one valve stem 30 and at least one switch baffle 31 disposed on the lateral air outlet 12 and is linked with the valve stem 30. The valve stem 30 is located on any sidewall in the lateral air outlet 12. Accordingly, a sliding groove 120 is disposed on the corresponding sidewall in the lateral air outlet 12 in order for the valve stem 30 to move up and down while a pivoting hole 121 for the switch baffle 31 to be pivoted on is also disposed on the corresponding sidewall. The sliding groove 120 arcs around (therefore in an arc shape) the pivoting hole 121 as a center (shown in FIG. 3 and FIG. 4). The valve stem 30 has a rod portion 300 and at least one pivoting portion 301 while the switch baffle 31 is provided with a pivoting shaft 310 and a sliding shaft 311. The pivoting shaft 310 is pivoted on the pivoting hole 121 while the sliding shaft 311 goes through the pivoting portion 301 and goes into the corresponding sliding groove 120. When the rod portion 300 of the valve stem 30 goes up and down, it drives the sliding shaft 311 of the switch baffle 31 to slide in the sliding groove 120. Thereby, the valve stem 30 may control the switch baffle 31 at the lateral air outlet 12 to be opened or be closed (as seen in FIG. 4 or FIG. 3).

Moreover, the cooling fan may further comprise an air inlet cover 13 and an air outlet cover 14. The air inlet 13 cover covers an axial air inlet 100 of the frame 1 and is with a main air intake 130 and a plurality of secondary air intakes 131 surrounding the main air intake in a manner corresponding to the axial blade 21 and the centrifugal blade 22 of the fan blade 2, respectively. On the other hand, the air outlet 14 cover covers an axial air outlet 101 of the frame 1 and is with a vent 140 corresponding to the axial blade 21 of the fan blade 2.

The assembly of aforementioned structure may result in the improved composite cooling fan of the disclosure.

As shown in FIG. 3, when the valve stem 30 is above the sliding groove 120 (the rod portion 300 of the valve stem 30 may protrude from the frame 1), the switch baffle 31 is blocking the lateral air outlet 12. As seen in FIG. 4, when the valve tem 30 moves downward to make the sliding shaft 311 slide in the sliding groove 120, the switch baffle 31 is driven to flip around its pivoting shaft 310. Thereby, the lateral air outlet 12 is opened so that the airflow led by the centrifugal blade 23 of the fan blade 2 blows out from the lateral air outlet 12. Meanwhile, since the switch baffle 31 arcs towards the lateral air outlet 12, it remains at an oblique angle after being opened. This enables airflow blown from an axial angle as well as from a lateral oblique angle, simultaneously.

What is claimed is:

1. A composite cooling fan, comprising:

a frame having an air hole penetrating the frame and a lateral air outlet locating on one side of the frame and connecting with the air hole;

a fan blade disposed in the air hole and comprising an impeller, a plurality of axial blades surrounding the impeller and a plurality of centrifugal blades surrounding the axial blades; and a lateral valve disposed on the lateral air outlet and comprising a valve stem and a switch baffle linked with the valve stem, wherein the valve stem is located on one of the sidewalls in the lateral air outlet, and the valve stem is configured for making the switch baffle at the lateral air outlet open or close;

wherein a sliding groove and a pivoting hole for the switch baffle to be pivoted on are disposed on the corresponding sidewall of the frame in the lateral air outlet, and the sliding groove arcs around the pivoting hole as a center.

2. The composite cooling fan according to claim 1, wherein the valve stem has a rod portion and a pivoting portion, a pivoting shaft and a sliding shaft are disposed on the switch baffle, the pivoting shaft is pivoted on the pivoting hole while the sliding shaft passes through the pivoting portion and passes into the sliding groove.

3. The composite cooling fan according to claim 2, wherein the rod portion of the valve stem protrudes from the frame.

4. The composite cooling fan according to claim 1, wherein the switch baffle arcs towards the lateral air outlet.

5. The composite cooling fan according to claim 1, wherein the air hole forms an axial air inlet and an axial air outlet on the frame.

6. The composite cooling fan according to claim 5, further comprising an air inlet cover and an air outlet cover, wherein the air inlet cover covers an axial air inlet of the frame while the air outlet cover covers an axial air outlet of the frame.

7. The composite cooling fan according to claim 6, wherein the air inlet cover corresponds to the axial blades and the centrifugal blades of the fan blade and therefore has a main air intake and a plurality of secondary air intakes surrounding the main air intake.

8. The composite cooling fan according to claim 6, wherein the air outlet cover has a vent corresponding to the axial blades of the fan blade.

9. The composite cooling fan according to claim 1, wherein a connecting ring is disposed on and surrounds the axial blades of the fan blade, and the centrifugal blades surround and are disposed on the connecting ring.

* * * * *